US006341474B1

(12) United States Patent
Focke et al.

(10) Patent No.: US 6,341,474 B1
(45) Date of Patent: Jan. 29, 2002

(54) CIGARETTE PACK AND PROCESS AND APPARATUS FOR PRODUCING THE SAME

(75) Inventors: Heinz Focke, Verden; Henry Buse, Visselhövede, both of (DE)

(73) Assignee: Focke & Co., (GmbH & Co.), Verden (DE)

( * ) Notice: Subject to any disclaimer, the term of this patent is extended or adjusted under 35 U.S.C. 154(b) by 0 days.

(21) Appl. No.: 09/283,306

(22) Filed: Apr. 1, 1999

(30) Foreign Application Priority Data

Apr. 3, 1998 (DE) ..... 198 14 932

(51) Int. Cl.[7] ..... B65B 51/10; B65B 11/28

(52) U.S. Cl. ..... 53/463; 53/456; 53/234; 53/377.4

(58) Field of Search ..... 53/415, 463, 456, 53/479, 136.3, 136.4, 136.5, 563, 234, 575, 377.4; 206/271, 259

(56) References Cited

U.S. PATENT DOCUMENTS 4,388,143 A * 6/1983 Buchholz et al. ..... 156/475
4,776,461 A * 10/1988 Focke et al. ..... 206/271
4,838,846 A 6/1989 Focke et al.
4,840,007 A * 6/1989 Focke et al. ..... 53/234
4,852,335 A 8/1989 Focke et al.
5,732,533 A * 3/1998 Focke et al. ..... 53/234
5,983,600 A * 11/1999 Heide et al. ..... 53/136.4

FOREIGN PATENT DOCUMENTS

| | | |
|---|---|---|
| DE | 2 219 540 | 10/1973 |
| DE | 37 01 427 | 7/1988 |
| DE | 195 35 649 | 3/1997 |
| EP | 514203 | 5/1992 |
| GB | 1 173 966 | 12/1969 |
| GB | 2130167 | 5/1984 |

* cited by examiner

*Primary Examiner*—S. Thomas Hughes
*Assistant Examiner*—Marc Jimenez
(74) *Attorney, Agent, or Firm*—Sughrue Mion, PLLC

(57) ABSTRACT

Cigarette pack of the soft-carton type, comprising an inner blank and an outer blank (12) which is designed in the form of a carton and is made of paper or the like. Folding tabs of the outer blank (12) , namely side tabs (18, 19) and folding tabs (20, 21) of the base wall, are connected to one another by adhesive bonding. For this purpose, hot-melt adhesive is applied in a precisely positioned manner in the region of a continuous material web for producing the outer blanks (12), to be precise the adhesive is applied as rectangular or square side applications of glue (27) and base applications of glue (28). Thereafter, the outer blanks (12) are severed from the material web and are processed in the customary manner in the region of a folding turret. In this case, the applications of glue are activated by heat before, during or after folding of the relevant folding tabs.

6 Claims, 12 Drawing Sheets

IV
41
51
22
22
23
44
44
47
48
45
43
43
42
46

CIGARETTE PACK AND PROCESS AND APPARATUS FOR PRODUCING THE SAME

BACKGROUND OF THE INVENTION

The invention relates to a cigarette pack of the soft-carton type, having an (outer) blank which is made of paper and encloses the pack contents, forming in the process a base wall, comprising folding tabs, and a side wall, comprising mutually overlapping side tabs, it being the case that the folding tabs of the base wall and the side tabs are connected to one another by adhesive bonding. The invention also relates to a process and an apparatus for producing packs of this type.

Soft-carton packs represent one of the cigarette packs which is used most widely throughout the world. These soft-carton packs usually comprise an inner blank which is made of tin foil or paper and fully envelops the pack contents—a cigarette group. A cigarette block formed in this way is positioned in a soft carton, that is to say a carton-like pack which is open at the top and is made of paper or similar packaging material. The soft carton has folding tabs which are adhesively bonded to one another in the region of the base wall and side tabs which are connected to one another, likewise by adhesive bonding, in the region of an upright, narrow side wall. Furthermore, usually a revenue stamp is provided as closure means. This revenue stamp extends in a U-shaped manner, transversely and centrally, over an end wall of the cigarette block. Legs are connected to the front wall and rear wall of the soft carton by adhesive bonding, Packaging machines for producing (cigarette) packs of this type are designed for increasingly high outputs. The latter result in problems, in particular, where the gluing of the packs or of the blanks is concerned.

SUMMARY OF THE INVENTION

The object of the invention is for the packs mentioned in the introduction to be developed further as far as the gluing or adhesive bonding is concerned such that areas of glue or applications of glue can be applied to folding tabs, side tabs, etc. at a high operating or conveying speed and the relevant regions of the blank can be glued to one another.

In order to achieve this object, the pack according to the invention is characterized in that the side tabs are connected to one another by a plurality of rectangular or square applications of glue comprising hot-melt glue, said applications being spaced apart from one another in the longitudinal direction of the side tabs, and the folding tabs of the base wall are connected to one another by a rectangular application of glue comprising hot-melt glue, said application running in the longitudinal direction of the base wall.

The use of hot-melt glue has advantages from a process-engineering standpoint. According to the invention, the applications of glue are already applied in the correct position to a continuous material web for the purpose of forming blanks for the pack, to be precise the applications are applied by stationary slotted nozzles, the material web being moved past the latter during appropriately controlled opening cycles of nozzle slots. Once the applications of glue have set, the material web can be processed without difficulty, that is to say blanks can be severed and folded.

A further special feature of the pack according to the invention consists in that the revenue stamp is connected to the pack exclusively by applications of glue comprising hot-melt glue in the region of front wall and rear wall of the soft carton. Accordingly, all applications of glue for the pack are provided on the material web for the purpose of producing soft-carton blanks.

The applications of glue are reactivated by heat in the region of the packaging machine. According to the invention, elements of the packaging machine are heated, with the result that heat is transferred onto those regions of the blank which have applications of glue. The elements heated are preferably those which are directly involved with the processing of those parts of the blank which are provided with applications of glue, that is to say they have a double function.

BRIEF DESCRIPTION OF THE DRAWINGS

Further details of the pack according to the invention, of the production process and of the apparatus are explained in more detail hereinbelow with reference to details of the packaging machine which are illustrated in the drawings, in which.

DETAILED DESCRIPTION OF THE INVENTION

Figure 7:
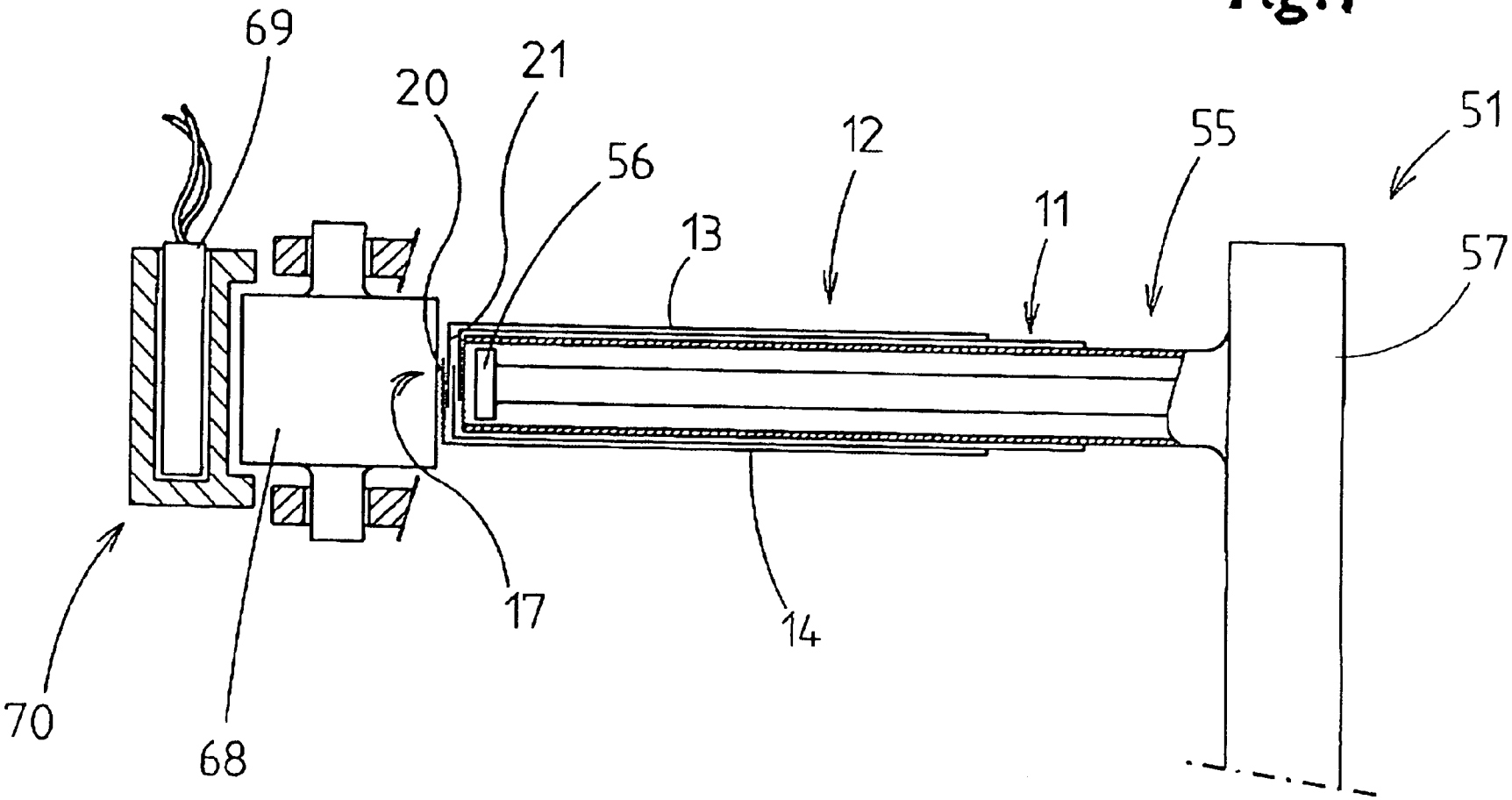
FIG. 7 shows a further detail of the folding turret in an axis-parallel section.
Figure 8:
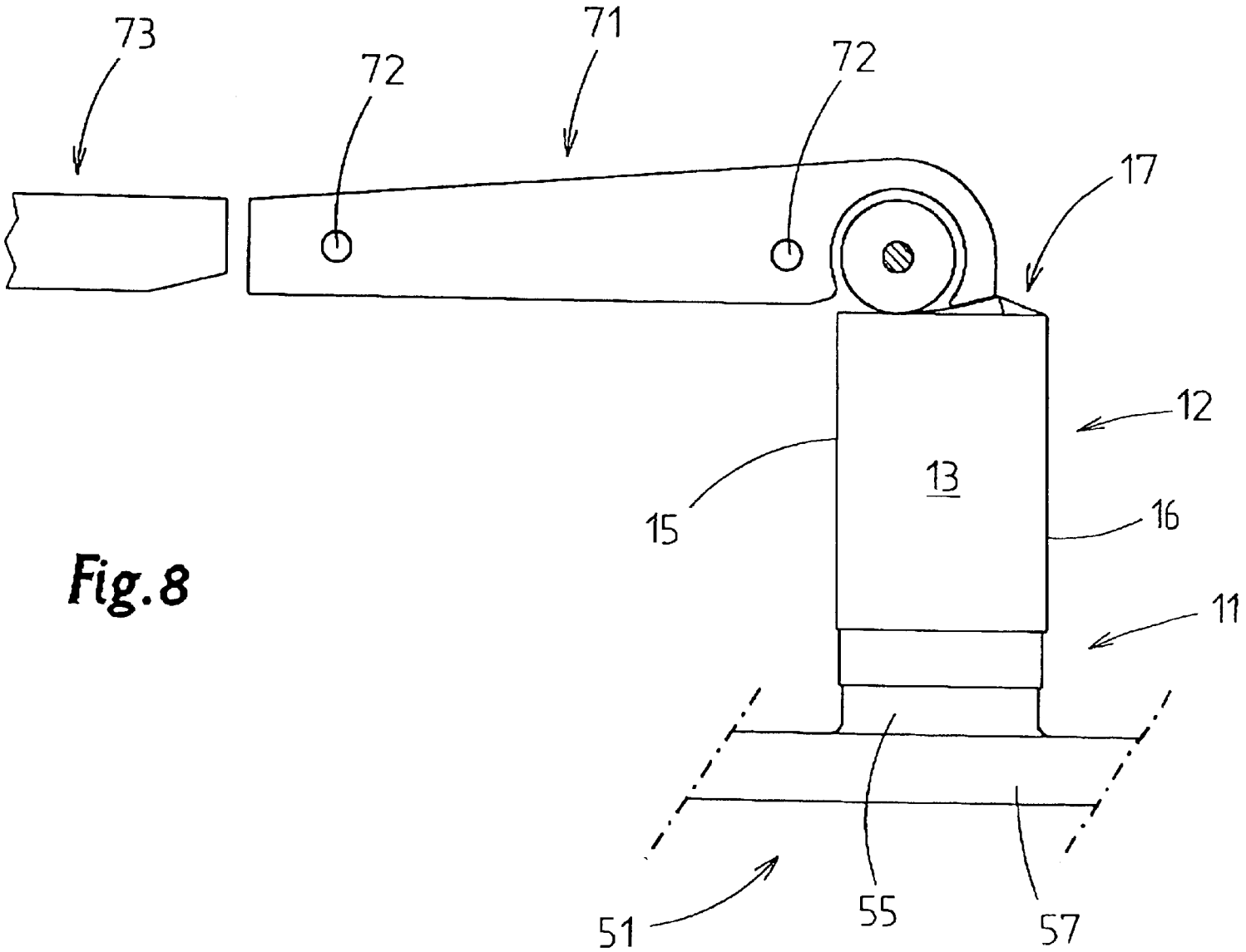
FIG. 8 shows a plan view of a folding or processing element of the folding turret.
Figure 9:
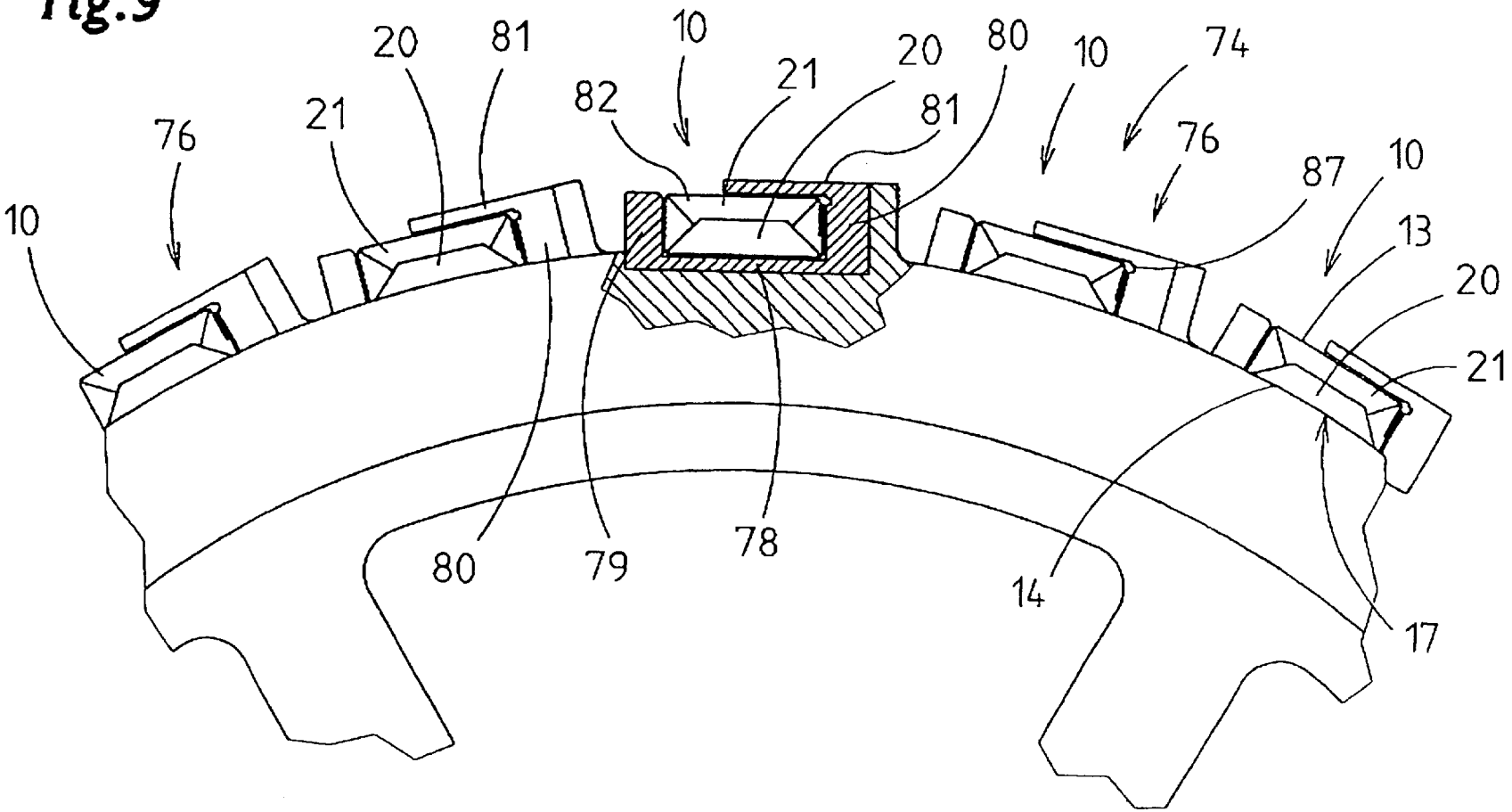
FIG. 9 shows, partly in section, an axial view of a sub-region of a drying turret.

The exemplary embodiments which are illustrated in the drawings are involved with the configuration and production of (cigarette) packs 10 of the soft-carton type. These comprise an inner blank 11 which is made of tin foil or paper and fully envelops the pack contents—a cigarette group. This produces a cigarette block, which is then enclosed by an outer blank 12 made of paper or similar material. The outer blank 12 is folded in the standard procedure so as to produce a soft carton (FIG. 7). The inner blank 11 or the cigarette block projects out of said soft carton to a slight extent at the top. The pack 10 formed in this way may be enclosed by a film blank.

Figure 1:
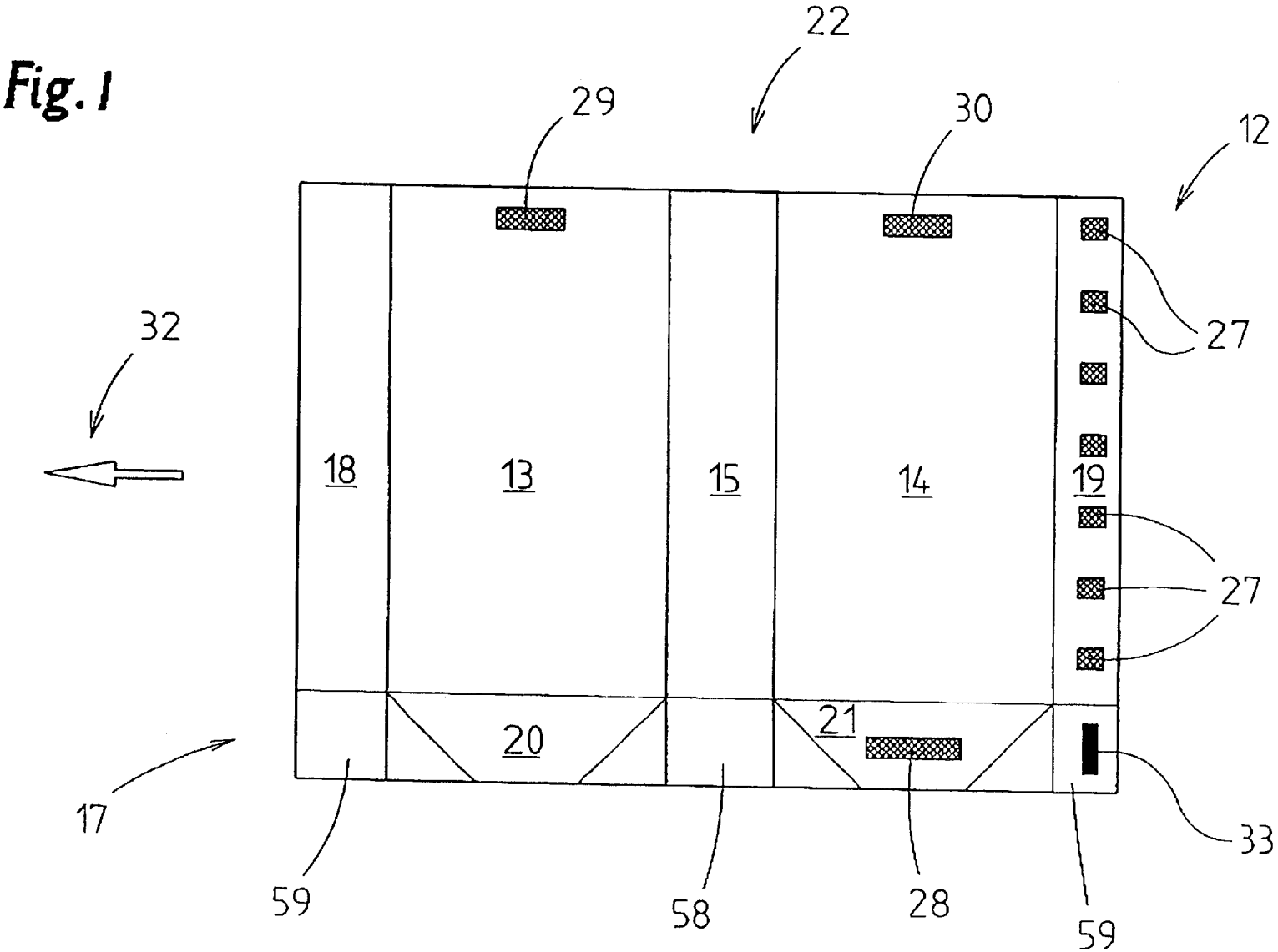
FIG. 1 shows a spread-out blank for a soft carton.
Figure 10:
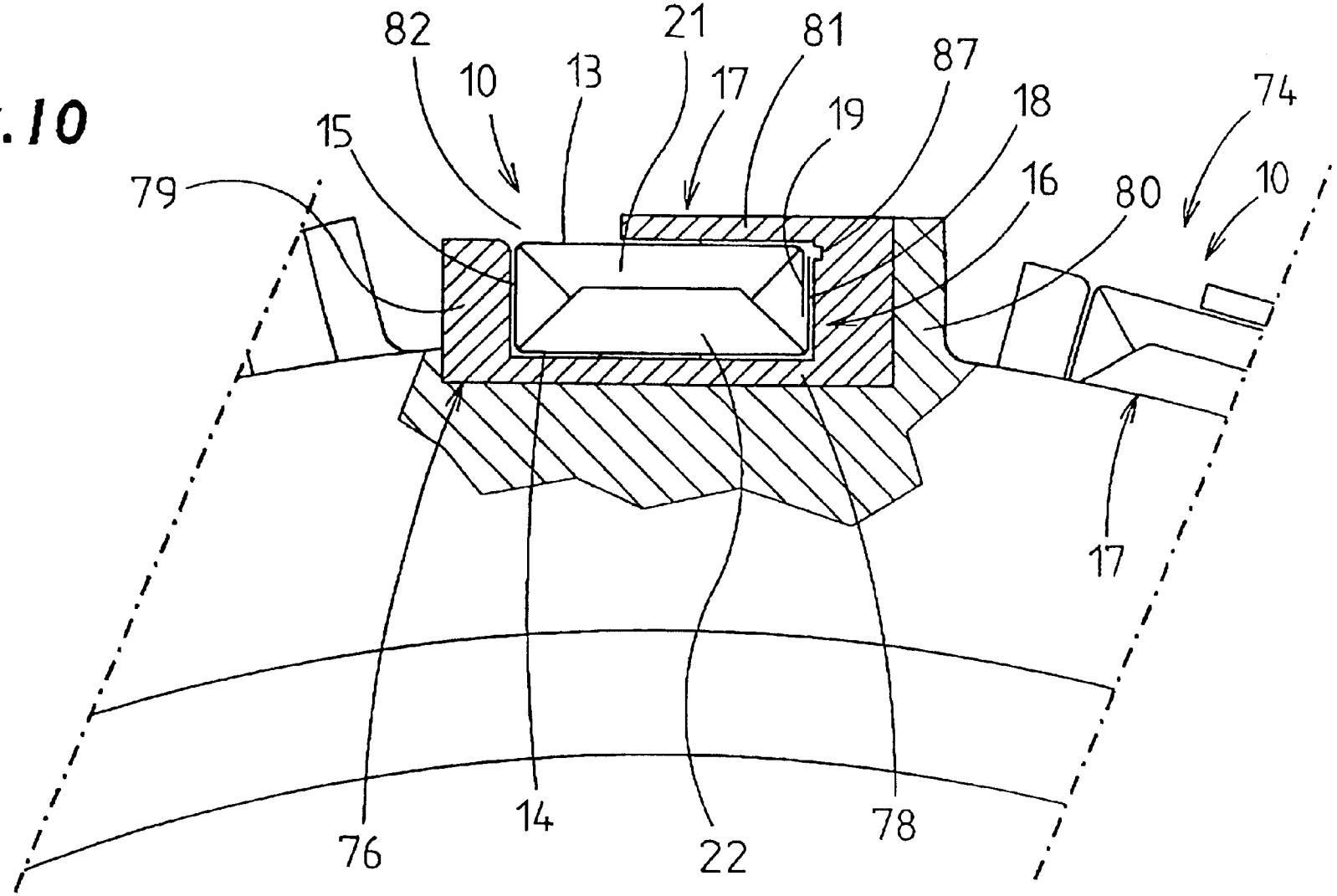
FIG. 10 shows, on an enlarged scale, a detail of the drying turret according to FIG. 9.

The outer blank 12 comprises, according to FIG. 1, a front wall 13, rear wall 14, side walls 15 and 16 and a base wall 17. The side wall 16 comprises two side tabs 18 and 19 which are each arranged on mutually opposite border regions of the outer blank 12 and wholly or partially overlap one another (e.g. FIG. 10).

The base wall 17 likewise comprises folding tabs, namely trapezoidal longitudinal tabs 20 and 21 and further rectangular or square and triangular base tabs.

In the same way as the side tabs 18 and 19, the longitudinal tabs 20, 21 are connected to one another by adhesive bonding.

The blank or outer blank 12 is provided with applications of glue comprising a glue which sets and can be reactivated by heat—so-called hot-melt glue—before the folding process, in the present case in the region of a continuous material web 22 made of paper or the like. The glue is applied to the material web 22 as the material web 22 is transported, in accordance with the configuration of the outer blank 12 (FIG. 1). For this purpose, the material web 22 is moved past a glue assembly 23.

The glue assembly 23 is equipped with at least one slotted nozzle 24. The latter has a plurality of nozzle slots arranged transversely with respect to the material web 22. These can be controlled, as far as the open and closed positions are concerned, such that rectangular or square applications of glue are transferred onto the material web 22 moving past them. The material web is pressed onto the slotted nozzle 24 by supporting rollers 25, 26. Otherwise, the glue assembly 23 is expediently designed in the manner illustrated and described in DE 195 35 649.7.

Taking the operation of the glue assembly 23 into consideration, an (outer) blank 12 according to FIG. 1 has applications of glue arranged in a particular manner. The (inner) side tab 19 is provided with a row of approximately square side applications of glue 27 which are arranged one beside the other and extend over the entire length of the side tab 19, to be precise on the outside of the outer blank 12. The side applications of glue 27 serve for the purpose of connecting the (inner) side tab 19 to the (outer) side tab 18.

An elongate, rectangular base application of glue 28 is arranged in the region of the inner longitudinal tab 21 for the purpose of connecting the folding tabs of the base wall 17. Said base application of glue connects the longitudinal tab 21 to the outer longitudinal tab 20 and thus fixes the base wall 17 as a whole.

A further special feature is the arrangement of in each case elongate, rectangular revenue-stamp applications of glue 29, 30. These are in the region of the front wall 13, on the one hand, and of the rear wall 14, on the other hand, to be precise central in each case and adjacent to a free, top border of the outer blank 12 These revenue-stamp applications of glue 29, 30 serve for the purpose of fixing downwardly directed legs of a revenue stamp 31 folded in a U-shaped manner. The revenue-stamp applications of glue 29, 30 are arranged at equal spacings from the free border of the outer blank 12 and are applied by a slot of the slotted nozzle 24, said slot also applying the side application of glue 27 on the border of the blank. The relevant nozzle slot is opened three times during the gluing of a blank, to be precise during transportation of the outer blank 12, as a region of the material web 22, in the direction of the arrow 32.

The precise actuation of the slotted nozzle 24 is ensured by control markings 33 which are provided at correct spacings on the material web 22.

Figure 2:
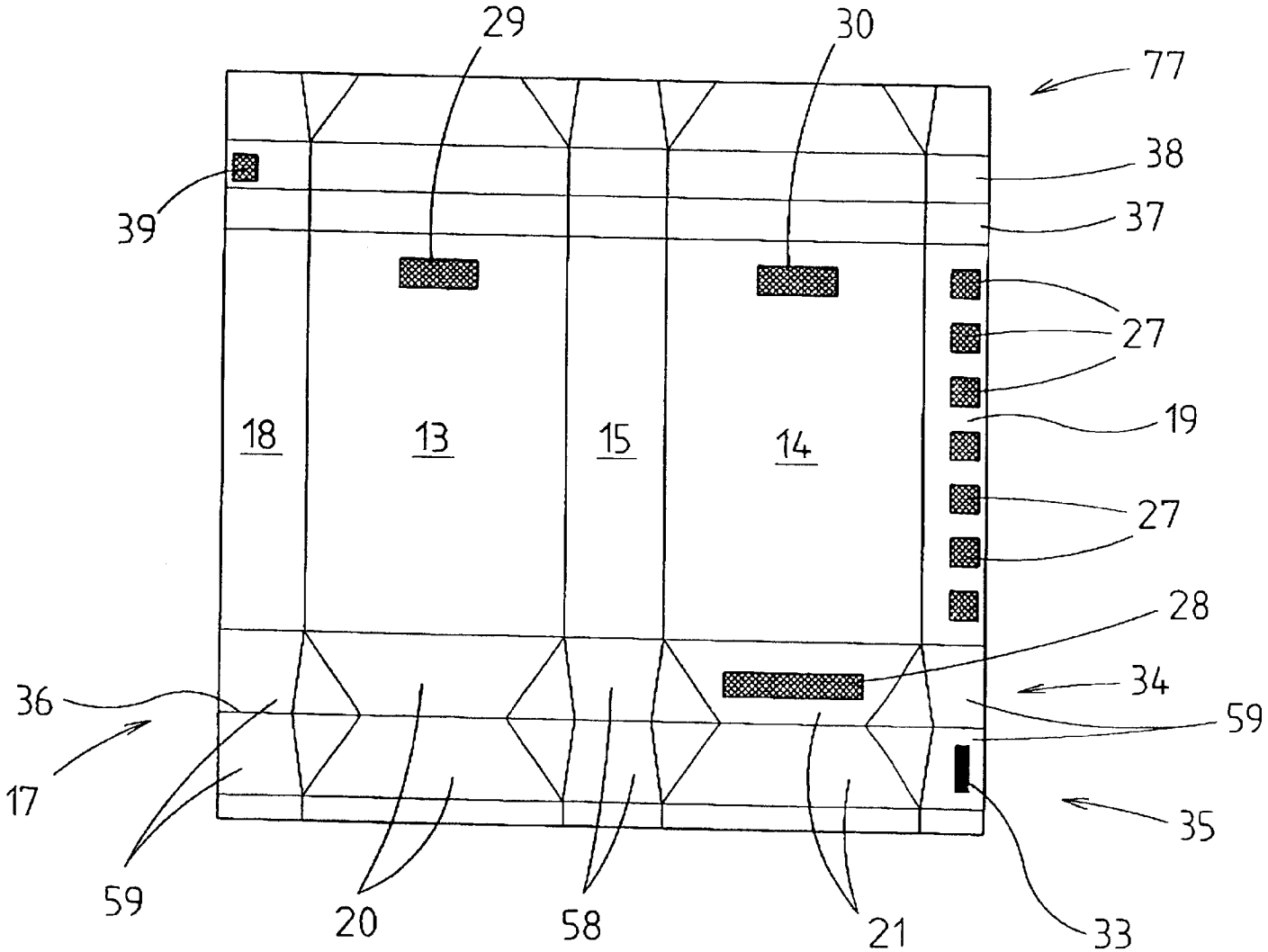
FIG. 2 shows a spread-out blank for another type of soft carton.

FIG. 2 shows an outer blank 12 which is intended for a modified pack of the soft-carton type. Details concerning the design and production of this particular soft-carton pack can be gathered from EP 0 649 797. The blank according to FIG. 2, which is likewise severed from a continuous web, forms two folding strips 34, 35 in the region of the base wall 17, which is to be folded. The folding strip 35 is folded against the folding strip 34 along a folding line 36, with the result that the outer blank 12 is of double-layered design in the region of the base wall 17. The folding tabs of the base wall 17 are then formed in the customary manner, namely with (double-layered) longitudinal tabs 20, 21. The inner longitudinal tab 21 is provided with the abovedescribed base application of glue 28 on the outside Accordingly, said application of glue is provided in the region of the folding strip 34, analogously to the blank according to FIG. 1.

In the region of an end wall 77 too, this soft pack is designed corresponding to EP 0 649 797, with a folding strip for the purpose of forming two folding legs 37, 38 of a Z-fold on the top border of the carton. The two folding legs 37, 38 are connected to one another by adhesive bonding. An approximately square Z-region application of glue 39 is provided in the region of the folding leg 38. This application of glue connects the two folding legs 37, 38 when the latter are folded in the form of a Z. The Z-region application of glue 39 is formed in the region of an extension of the side tab 18.

As far as the provision of side applications of glue 27 is concerned, the side tab 19 is designed in the same manner as the blank according to FIG. 1, that is to say with seven spaced-apart rectangular or square side applications of glue 27. Revenue-stamp applications of glue 29, 30 are positioned in the region of the front wall 13 and rear wall 14, to be precise adjacent to a folding edge 40, which in the case of this type of pack forms a top border of the (apparent) carton. The Z-region application of glue 39 is expediently activated together with the side applications of glue 27, that is to say on the folding mandrel 55 by the folder 65. It is also possible, however, for the Z-region application of glue 39 to have been activated already in the region of the correspondingly folded material web for producing blanks with a Z-fold.

Figure 3:
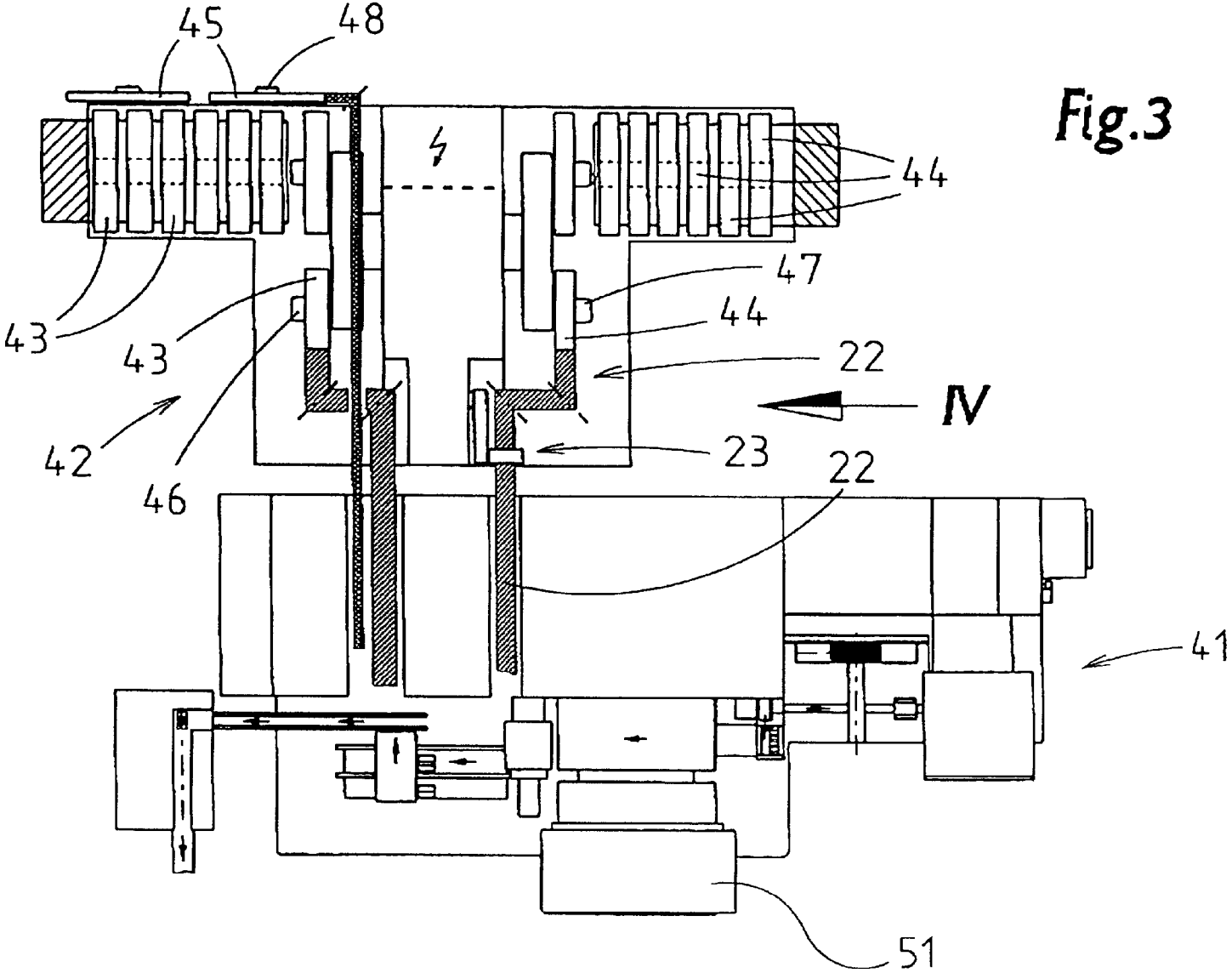
FIG. 3 shows a schematic plan view of an installation for producing (cigarette) packs of the soft-carton type.
Figure 4:
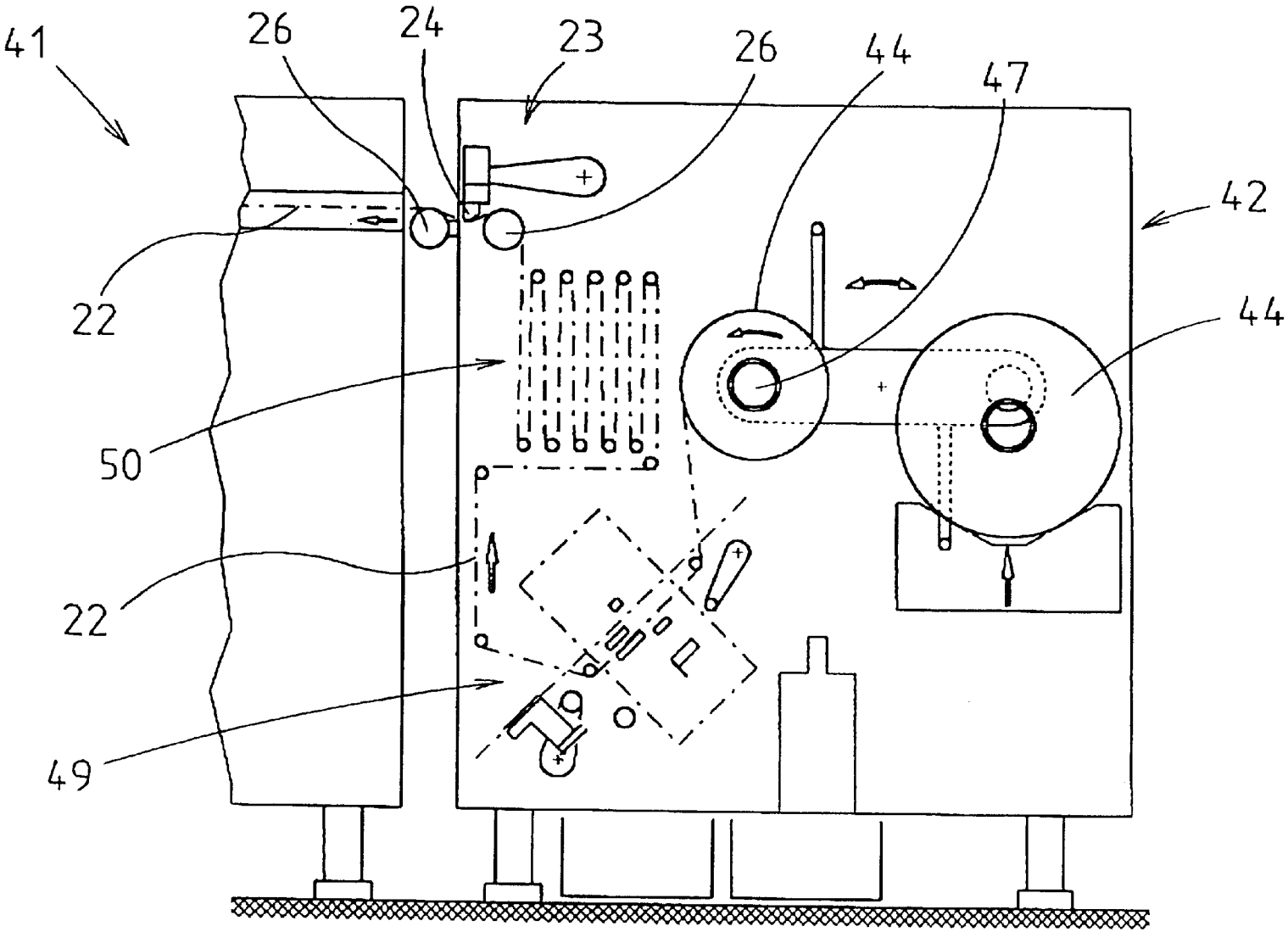
FIG. 4 shows, on an enlarged scale, a detail of the installation according to FIG. 3 corresponding to arrow IV in FIG. 3.
Figure 5:
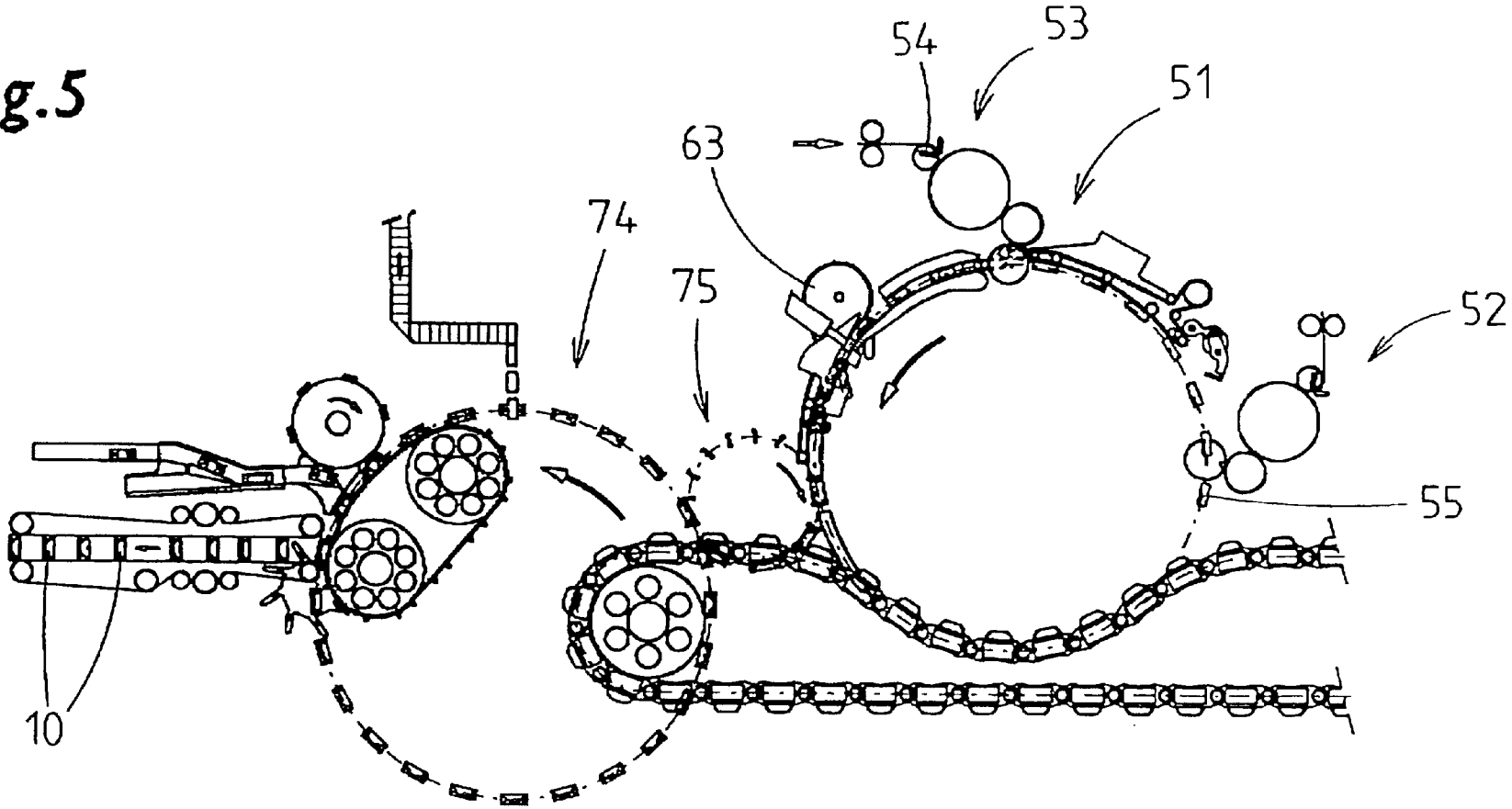
FIG. 5 shows a schematic side view of a sub-region of a packaging machine.

A production installation according to FIG. 3 serves for producing packs 10 of the type described. This installation comprises a packaging machine 41 and a separate material unit 42. The latter is positioned on the rear side of the packaging machine 41 and is expediently designed in accordance with DE 198 04 614.6. The material unit 42 contains reel magazines for the web-like packaging material which is to be processed. These are, on the one hard, tin-foil reels 43 and, on the other hand, paper reels 44, and revenue-stamp reels 45 are also provided.

The reels 43, 44, 45 are mounted rotatably in each case on an operating stub 46, 47, 48, with the result that the material webs can be drawn off. These material webs are fed to the packaging machine 41. Of particular interest in the present case is the material web 22 for producing the (outer) blanks 12 made of paper.

The material web 22, which is drawn off from, the respective paper reel 44 on the operating stub 47, runs through a splicing assembly 49, which has the task of connecting a finishing material web 22 to a new material web of a reel which is to be joined up. Thereafter, the material web 22 runs through a web store 50 for the purpose of compensating for differences in movement. This is followed by the abovedescribed glue assembly 23, which in this case is arranged in the region of the material unit 42.

The material web 22, provided with glue or applications of glue in the manner described, is fed to a folding assembly, that is to say to a folding turret 51 which rotates continuously in the upright plane. This folding turret is assigned circumferentially spaced-apart assemblies for the task of feeding the material web 22 and for the task of severing the blanks 11 and 12. Otherwise, the folding turret 51 may be designed in accordance with US 4 852 335.

A material web made of tin foil is fed in the region of a tin-foil station 52 for the purpose of forming inner blanks 11.

Arranged in a position offset with respect to this in the circumferential direction is the paper station 53. The latter has a severing assembly 54 for the purpose of severing the (outer) blanks 12 from the material web 22.

For the purpose of producing packs 10 of the soft-carton type, the folding turret 51 is provided with a plurality of circumferentially spaced-apart material-receiving means, namely so-called folding mandrels 55. These are elongate hollow bodies which are open at both ends and whose dimensions correspond to the inner dimensions of the pack 10. The blanks, namely inner blank 11 and outer blank 12, are folded on the outside of the thin-walled hollow mandrels 55. The pack contents, namely a cigarette group, are introduced into the folding mandrel 55 in the longitudinal direction by a push rod 56. For the purpose of forming the filled pack 10, the cigarettes are pushed out by the push rod 56, the partially folded blanks 11, 12 being carried along in the process.

As can be seen from FIG. 7, in the region of the paper station 53, the outer blanks 12 are placed in the correct position on the folding mandrel 55 or on the inner blank 11. The base wall 17 is folded against an already folded base wall of the inner blank 11.

In the initial position, a material strip for the purpose of forming the folding tabs of the base wall 17 projects beyond the free side of the folding mandrels 55, connected to a turret plate 57. First of all an inner tab 58 is folded, by a stationary folding finger (not shown). Thereafter, an opposite inner tab 59, which is at the rear in the transporting direction, is folded, from parts of the side tabs 18, 9, by a movable folding finger 60. Thereafter, the radially outer and inner longitudinal tabs 20, 21 are folded by fixed folding deflectors 61, 62, as a result of the movement relative to the latter.

Before the inner tab 59 is folded over, the side tabs 18, 19 are folded. The radially outer side tab 19, which is located on the inside of the finished pack 10, is first of all folded against the rear side surface of the pack 10, as seen in the movement direction, by a folding element, to be precise by a folding wheel 63 with projecting folding webs 64. Thereafter, or in a simultaneous movement, the radially inner, cuter side tabs 18 are folded by a separate, movable folding element. This is an angled folder 65 which uses a folding leg 66, projecting at right angles, to grip the side tab 18 and fold it over against the approximately radially directed side surface of the pack 10 or of the folding mandrel 55. For this purpose, the folder 65, which is assigned to each folding mandrel 55, is mounted pivotably.

Before, during or after folding of the folding tabs coated with applications of glue, the applications of glue have to be activated by the supply of heat.

Figure 6:
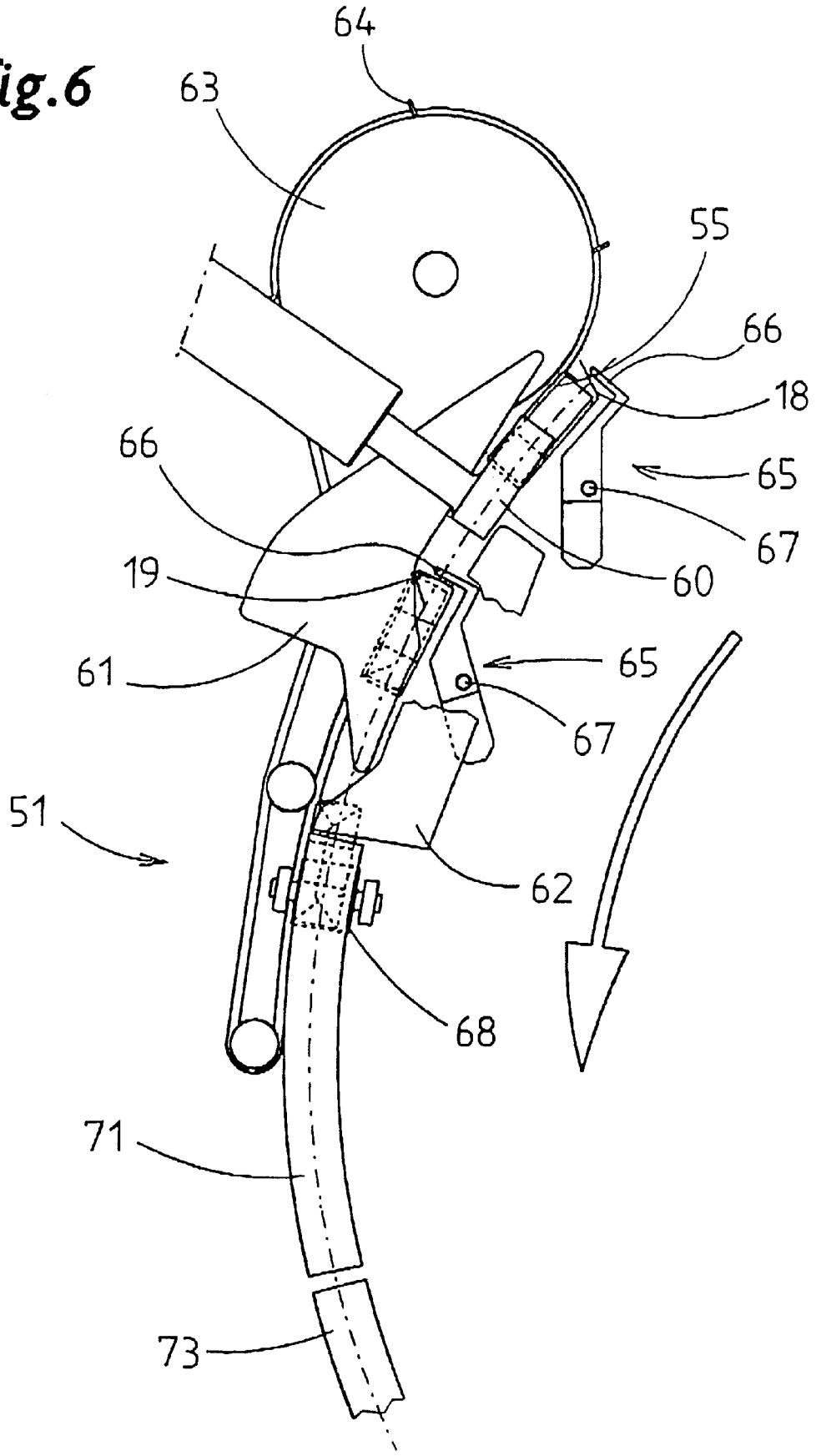
FIG. 6 shows, on an enlarged scale, a schematic side view of elements of a folding turret of the packaging machine.

The first to be activated are the side applications of glue 27 for the purpose of connecting the side tabs 18 and 19. The heat required for this purpose is transferred by folding elements, namely by the folder 65. The latter is heated throughout or in the region of the folding legs 66. For this purpose, an (electric) heating cartridge 67 is provided on each folder 65. This heating cartridge is activated during the folding operation (FIG. 6), in particular during abutment of the folding legs 66 against the side tab 18. In this case, the heat is transferred over a sufficient period of time since the folder 65, in the folding position, runs along with the folding mandrel 55.

The applications of glue arranged in the region of the base wall 17, namely the base application of glue 28, are/is activated following the side applications of glue 27. Following the abovedescribed folding steps for the base wall 17, a pressure-exerting element for the folding tabs of the base wall 17 is arranged in a stationary manner. This element is a pressure-exerting roller 68. The blanks 11, 12 still positioned on the folding mandrel 55 are moved past said pressure-exerting roller such that the folding of the base wall 17 is stabilized by transferred pressure. On the inside, namely in the folding mandrel 55, the push rod 56 acts as a counterpressure element. The pressure-exerting roller 68 is heated (indirectly), to be precise by a heating cartridge 69 which is mounted within a mount 70 for the pressure-exerting roller 68.

The (heated) pressure-exerting roller 68 is adjoined, in the conveying direction, by a heated pressure-exerting part 71. The latter is configured as an arcuate shaped body in accordance with the movement path of the pack 10 or of the base wall 17. The latter slides on the pressure-exerting part 71 during a section of the circular movement. In the present case, the pressure-exerting part 71 is a part, or continuation, of the mount 70 for the pressure-exerting roller 68. Heating cartridges 72 are positioned at a suitable location in the pressure-exerting part 71 for the purpose of heating the same.

The pressure-exerting part 71 is adjoined in the conveying direction by a pressure-exerting plate 73, which is a further pressure-exerting element for the base wall 17. The pressure-exerting plate 73 is not heated, and may be cooled in order to stabilize the connection of the folding tabs of the base wall 17. This base wall slides along the fixed pressure-exerting plate 73 during the conveying movement.

The revenue stamp 31 is applied and adhesively bonded in the region of a drying turret 74. Unless described or illustrated to the contrary, this drying turret may be designed in accordance with U.S. Pat. No. 5,544,467. The packs 10 completed and filled in the region of the folding turret 51 are fed to the drying turret 74 via a transfer turret 75. The drying turret comprises a plurality of hollow bodies, namely drying tubes 76, which are arranged along the circumference and through which the packs 10 are transported in an axis-parallel direction, to be precise by virtue of a new pack 10 being pushed in at one end of a drying tube 76 and a finished pack 10 emerging on the opposite side of the drying tube 76. In the case of the present example, each drying tube 76 is designed such that three packs 10 are accommodated one after the other in the drying tube, it being the case that the front end walls 77, as seen in the push-through direction, are supported in each case on the base wall 17 of a preceding pack 10.

The drying tube 76 is designed with an approximately C-shaped cross section, that is to say a radially inner tube base 78, approximately radially directed side guides 79, 80 and an outer wall 81. The latter extends only over a sub-region of the outwardly directed large-surface-area wall of the pack, that is to say of the front wall 13. This results in an open slot 82 running in the longitudinal direction of the drying tube 76.

In the region of the drying tube 76, the revenue stamps 31 are provided on the front end wall 77, as seen in the conveying direction. By virtue of the relevant pack 10 being pushed into the associated drying tube 76, the revenue stamp 31 is folded over in a U-shaped manner, with the result that legs 83, 84 butt against front wall 13 and rear wall 14, to be precise in the region of the revenue-stamp applications of glue 29, 30.

Figure 11:
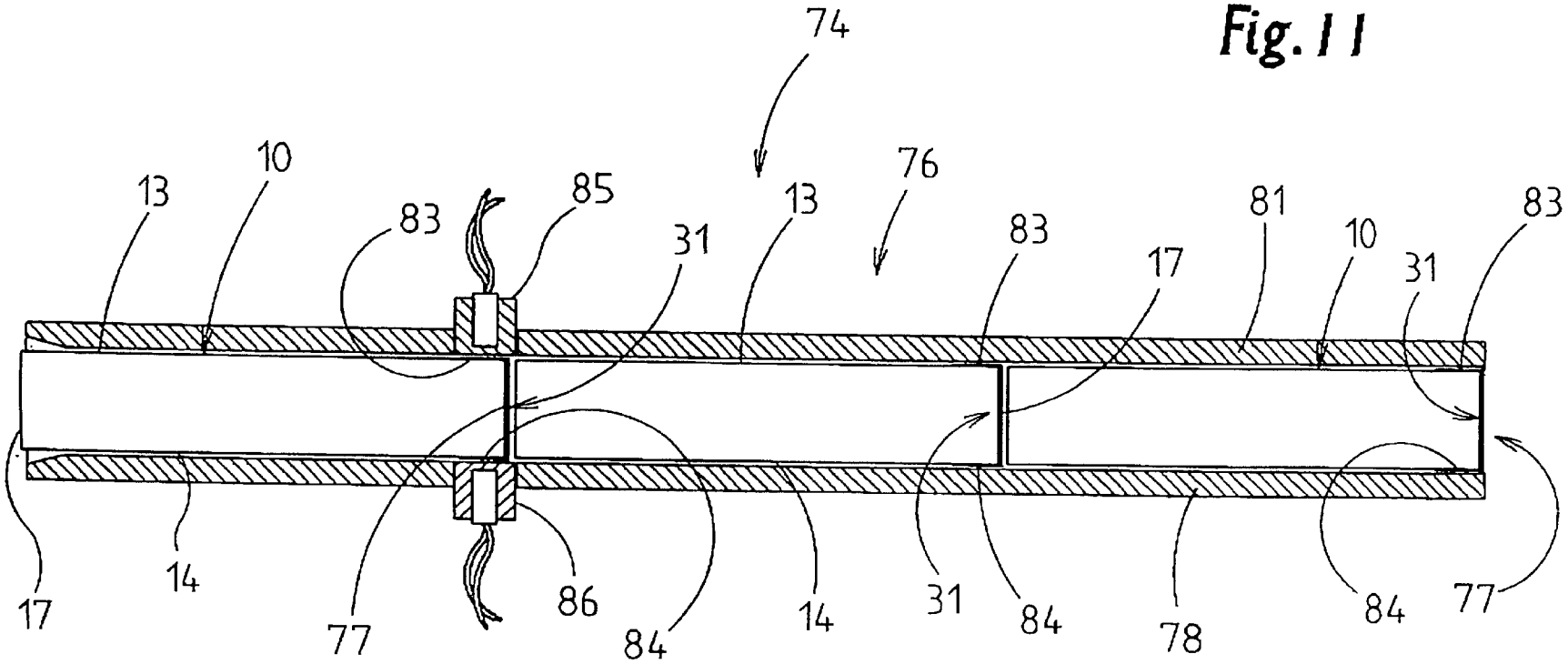
FIG. 11 shows an element of the drying turret, namely a drying tube, in longitudinal section.
Figure 12:
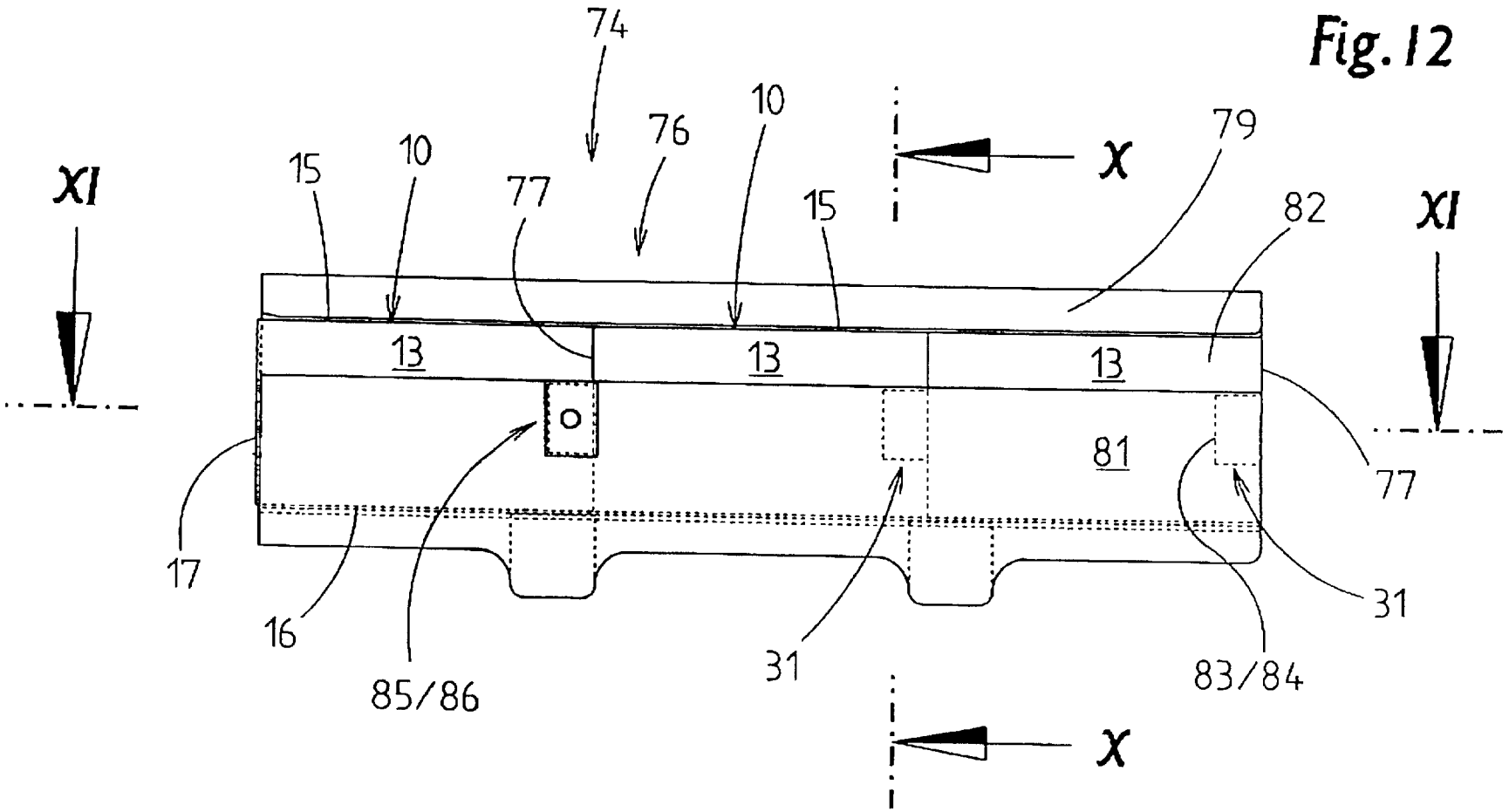
FIG. 12 shows a plan view of the drying tube according to FIG. 11.

The revenue-stamp applications of glue 29, 30 for the purpose of fixing the revenue stamp 31 are activated once the revenue stamp 31 has been folded, namely in the region of the drying tube 76. For this purpose, heating elements, namely heating cartridges 85, 86, are arranged at a certain position of the drying tube 76, in the tube base 78 and in the outer wall 81 opposite this. These heating cartridges are each positioned at the location at which the revenue-stamp applications of glue 29, 30 are located once a (new) pack 10 has been pushed into the drying tube 76 (FIG. 11). Virtually an entire revolution of the drying turret 74 is available for the activation of the revenue-stamp applications of glue 29, 30. Thereafter, that is to say following further movement of pack 10, the glue connection can set, while being fixed by the drying tube 76.

The packs emerging from the drying tube 76 are processed further in a known manner, for example in accordance with EP 0 770 551.

The drying tubes 76 are designed in a particular way. In the region of the transition from the side guide 80 into the outer wall 81, there is formed a collecting channel 87 which extends in the longitudinal direction of the drying tube 76. This collecting channel serves for receiving any residues of glue which may emerge from the region between the side tabs 18 and 19.

Alternatively, the apparatus may also be operated such that the activation of all the applications of glue does not take place until the drying turret or the drying tubes 76 has/have been reached. In this case, for example pusher elements for the purpose of pushing the packs 10 into the drying tubes 76 are heated for the purpose of activating the base applications of glue 28. Furthermore, it is possible for the side guide 80 to be heated for the purpose of activating the side applications of glue 27.

The applications of glue may also be applied to the material web in other ways, for example by offset printing or intaglio printing. It is also possible for applications of glue which can be activated to be provided on the material web during the production, that is to say printing, of the latter, this resulting in finished material webs, as far as the applications of glue are concerned, being supplied.

LIST OF DESIGNATIONS

10 Pack
11 Inner blank
12 Outer blank
13 Front wall
14 Rear wall
15 Side wall
16 Side wall
17 Base wall
18 Side tab
19 Side tab
20 Longitudinal tab
21 Longitudinal tab
22 Material web
23 Glue assembly
24 Slotted nozzle
25 Supporting roller
26 Supporting roller
27 Side application of glue
28 Base application of glue
29 Revenue-stamp application of glue
30 Revenue-stamp application of glue
31 Revenue stamp
32 Arrow
33 Control marking
34 Folding strip
35 Folding strip
36 Folding line
37 Folding leg
38 Folding leg
39 Z-region application of glue
40 Folding edge
41 Packaging machine
42 Material unit
43 Tin-foil reel
44 Paper reel
45 Revenue-stamp reel
46 Operating stub
47 Operating stub
48 Operating stub
49 Splicing assembly
50 Web store
51 Folding turret
52 Tin-foil station
53 Paper station
54 severing assembly
55 Folding mandrel
56 Push rod
57 Turret plate
58 Inner tab
59 Inner tab
60 Folding finger
61 Folding deflector
62 Folding deflector
63 Folding wheel
64 Folding web
65 Folder
66 Folding leg
67 Heating cartridge
68 Pressure-exerting roller
69 Heating cartridge
70 Mount
71 Pressure-exerting part
72 Heating cartridge
73 Pressure-exerting plate
74 Drying turret
75 Transfer turret
76 Drying tube
77 End wall
78 Tube base
79 Side guide
80 Side guide
81 Outer wall
82 Slot
83 Leg
84 Leg
85 Heating cartridge
86 Heating cartridge
87 Collecting channel

What is claimed is:

1. A process for producing cigarette packs of the soft-carton type from an outer blank (12) which is severed from a continuous material web (22), which is made of paper and which has folding tabs connected to one another by adhesive bonding, and wherein, in a region of an end wall (77) of a pack to be produced, there is to be applied a revenue stamp (31) which extends transversely across the end wall (77) and which is adhesively attached, by stamp legs (83, 84), in regions of an adjacent front pack wall (13) and a rear pack wall (14), said method comprising the steps of:

a) providing the material web (22) with applications of glue (29, 30) in web regions to which the legs (83, 84) of the revenue stamp (31) arc to be glued, said web regions corresponding to the front pack wall (13) and rear pack wall (14); and b) after the cigarette pack and a U-shaped fold of the revenue stamp (31) have been completed, activating the applications of glue (29, 30) by contact heat during abutment of the legs (83, 84) against the front wall (13) and the rear wall (14) in such a way that the legs (83, 84) are connected to the front wall (13) and rear wall (14) by means of said applications of glue (29, 30).

2. The process according to claim 1, further comprising the steps of:

a) pushing a cigarette pack (10), with an end wall (77) thereof facing forwards in a conveying direction, into a drying tube (78) of a drying turret;

b) as the cigarette pack (10) is pushed into the drying tube (74), folding the revenue stamp (31) in a U-shape around the end wall (77) in such a way that the legs (83, 84) lie on the front wall (13) and rear wall (14) of the pack; and c) in the region of the drying tube (74), applying heat and pressure to the pack in regions of the legs (83, 84) during a standstill phase of the pack.

3. A process for producing cigarette packs of the soft-carton type with an outer blank (12) which is severed from a continuous material web (22), which is made of paper, and which has folding tabs connected to one another by adhesive bonding, said process comprising the following steps:

a) applying glue (27, 28) of the hot-melt type to the material web (22) in regions of outer blanks (12) which are to be subsequently severed;

b) to interconnect an outer (18) and an inner (19) elongated side tab of the outer blank (12), applying to the inner side tab (19) glue (27) comprising a plurality of individual rectangular or square first areas of glue (27) which are spaced apart from one another in a longitudinal direction of the inner side tab (19);

c) to interconnect elongated folding base tabs (20, 21) of a pack base wall (17) of the outer blank (12), applying to the web (22), in a region of one (21) of the elongated folding base tabs, an elongated second area of glue (28) running in the longitudinal direction of the one elongated folding base tab (21);

d) applying the first and second areas of glue (27, 28) during a conveying movement of the web (22);

e) after the first and second areas of glue (27, 28) on the web (22) have set, severing blanks (12) from the material web (22), and folding each severed blank around a block of cigarettes; and f) immediately before, during or after folding of the side and base tabs (18, 19; 20, 21), activating the first and second areas of glue (27, 28) by applying heat thereto, and applying pressure to the side tabs and to the base tabs to interconnect the side tabs and to interconnect the base tabs.

4. The process according to claim 3, wherein the applied first areas of glue (27), for interconnecting the blank side tabs (18, 19) to form a pack side wall (16), are activated by heated folding elements during and after folding of the outer blank (12) on a folding mandrel (55) of a folding turret (51).

5. The process according to claim 3, wherein, after the elongated base tabs (20, 21), forming the pack base wall (17), are folded on a folding mandrel (55) of a folding turret (51), the second glue area (28) is activated by heated pressure-exerting elements on an inner side of the base wall (17) and on an outer side of the base wall (17), thereby to connect the base tabs to one another.

6. The process according to claim 3, for the production of cigarette packs from a one-piece outer blank (12) having a Z-fold formed from folding legs (37, 38) of the outer blank (12), further comprising the step of providing the material web (22) with a third area (39) of glue in a region of one of the folding legs (38), which region is positioned between the folding legs (37, 38), after they are folded, in such a way that, due to application of heat and pressure, the folding legs (37, 38) are connected to one another in a vicinity of the third area (39) of glue.

* * * * *